US005564173A

United States Patent [19]

Sedman et al.

[11] Patent Number: 5,564,173

[45] Date of Patent: Oct. 15, 1996

[54] CERAMIC THREAD CLEANER WITH SINGLE PIECE CONSTRUCTION

[75] Inventors: Benny Sedman, Laurens, S.C.; Bill Cooper, Signal Mountain, Tenn.

[73] Assignee: A1SiMag Technical Ceramics, Inc., Laurens, S.C.

[21] Appl. No.: 367,439

[22] Filed: Dec. 29, 1994

[51] Int. Cl.[6] ..... D02J 3/14

[52] U.S. Cl. ..... 28/232; 28/224

[58] Field of Search ..... 28/222, 224, 229, 28/230, 231, 232, 233; 264/67; 242/36, 157 R, 615.3, 615.4

[56] References Cited

U.S. PATENT DOCUMENTS

| | | | |
|---|---|---|---|
| 390,326 | 10/1888 | West | 28/224 |
| 447,031 | 6/1892 | Weaver . | |
| 866,890 | 9/1907 | Schmidt | 28/222 X |
| 1,774,987 | 9/1930 | Madden | 28/232 |
| 1,812,428 | 6/1931 | Bloom . | |
| 2,007,733 | 7/1935 | Welton | 28/232 |
| 2,019,644 | 11/1935 | Baker et al. | 28/232 |
| 2,061,386 | 11/1936 | Osborne et al. | 28/224 |
| 2,131,859 | 10/1938 | Schmadeke | 28/70 |
| 2,165,405 | 7/1939 | Munson | 28/70 |
| 2,232,441 | 2/1941 | Duraffourg | 28/70 |
| 2,625,732 | 1/1953 | Abbott | 28/64 |
| 2,720,020 | 10/1955 | Tager | 28/224 |
| 2,746,120 | 5/1956 | Moos | 28/64 |
| 2,963,768 | 12/1960 | Brame et al. | 28/232 |
| 3,503,105 | 3/1970 | Sizemore | 28/72.14 |

FOREIGN PATENT DOCUMENTS

| | | | |
|---|---|---|---|
| 1127261 | 4/1962 | Germany | 28/224 |

*Primary Examiner*—John J. Calvert
*Attorney, Agent, or Firm*—Hardaway Law Firm, P.A.

[57] ABSTRACT

A method of manufacturing a single-piece, ceramic thread cleaner having a crotch and a slot. The thread cleaner's body is pressed to the final dimensions and a slot with polished surfaces is cut into the body using a diamond cut-off saw. The benefits provided by this threadcleaner are simple design, easy manufacturing, high slot width accuracy, dimensional stability of the slot over a long period of time, increased wear resistance compared to thread cleaners made of metal, and easy installation in a textile machine.

9 Claims, 1 Drawing Sheet

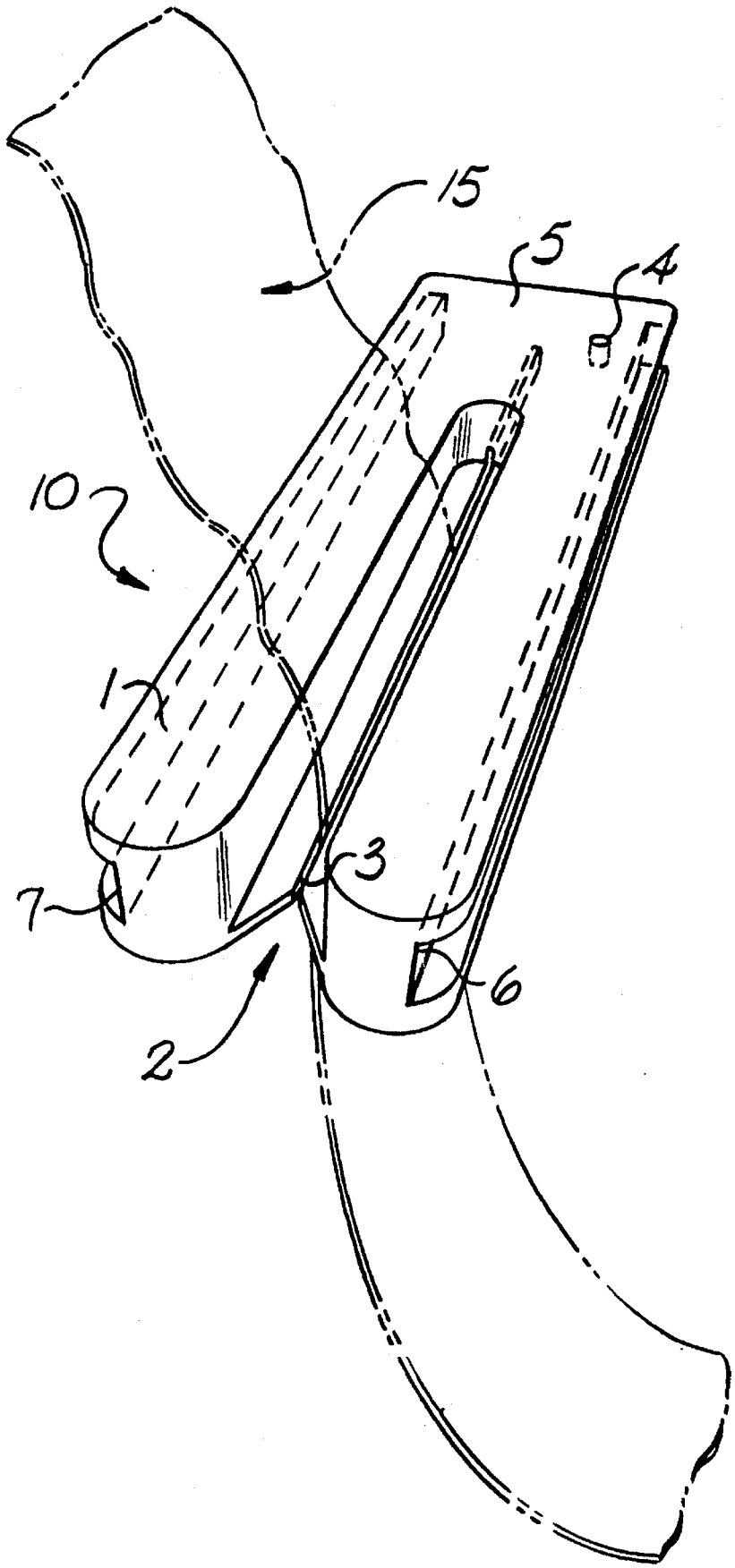
15
5
4
10
1
3
7
6
2

CERAMIC THREAD CLEANER WITH SINGLE PIECE CONSTRUCTION

This invention relates to the art of yarn, ribbon, and thread cleaning devices and more particularly to the art of manufacturing a self aligning ceramic thread cleaner consisting of a single, all-ceramic piece.

Prior to winding thread (or yarn) or a plurality of threads or yarns, like ribbon, onto spindles it must be thoroughly cleaned of undesirable material such as slubs. Therefore, the thread is fed through a slot of substantially the same width as the thread being handled. Thus, material exceeding the desired thread size is removed by the sharp edges of the slot. Many variations of thread cleaners are known in the art. U.S. Pat. 1,774,987, to Madden, discloses a thread cleaner made of ceramic material instead of metal, thereby providing cutting edges with greater wear resistance. Madden teaches a flaring slit at the thread cleaner's upper end for the easy reception of a thread. The slit gradually narrows towards its lower end, where it terminates in a transverse bore. The thread is fed through the bore which is accurately formed by drilling the bore to a desired gauge. The bore provides both cleaning and guiding of the thread. In Madden, the slit's dimensions are not kept in small tolerances because only the dimension of the bore is critical since the bore —and not the slit—is where the thread is fed through. Madden's thread cleaner, however, causes problems because, for many applications, feeding thread through a bore is not acceptable. Such an application where feeding the thread through a bore is not acceptable is when slubs and impurities are to be removed from ribbons or a plurality of threads, for example, a yarn. Madden is simply incapable of removing slubs and impurities from ribbons or a plurality of threads. U.S. Pat. No. 1,812,428, to Bloom, teaches the use of a unitary elongated plate having a V-shaped crotch on the top end communicating with a vertical slit through which the thread is fed. This device, however, is used as a "slub detector" and, therefore, it does not have the sharp edges required for cleaning thread or removing slubs. Furthermore, because this device is not subject to the wear of a slub catcher or thread cleaner, there is no suggestion to use ceramics. U.S. Pat. No. 2,232,441, to Duraffourg discloses an example of a thread cleaner with a vertical slit having parallel ceramic blades on each side of the slit. Duraffourg's blades are exchangeable allowing replacement of worn blades and for adapting the device to different thread sizes by simply exchanging one blade for another of a different size. The ceramic blades are usually polished prior to mounting them to the thread cleaner's body. However, a proper parallel alignment of the polished ceramic blades providing a slot with close tolerances—an essential requirement to thread cleaners especially when ribbons are cleaned from slubs—is difficult and cumbersome to attain. Another disadvantage of this device is its complex and costly arrangement because it consists of several parts. In other priori art thread cleaners the ceramic blades are epoxied to a metal body prior to polishing the blades. In the mounted position, each blade is polished separately to generate the desired slit tolerances. This procedure is also cumbersome and requires a high level of skill. Furthermore, maintaining dimensional stability in an ! epoxied thread cleaner is quite difficult because epoxy sometimes fails, e.g., due to heat generation.

Therefore, room for improvement exists in the art.

SUMMARY OF THE INVENTION

Thus, it is an object of this invention to provide a thread cleaner which is easy to manufacture.

It is a further object of this invention to,provide a thread cleaner which is suitable for the use for thread or yarn as well as for a plurality of threads or yarns, and ribbon.

It is a still further object of this invention to provide a thread cleaner which provides close tolerances over the length of the thread cleaner's slot.

It is a still further object of this invention to provide a thread cleaner which maintains dimensional stability over a long period of time.

It is a still further object of the invention to provide a thread cleaner having a high corrosion resistance.

It is a still further object of this invention to provide a thread cleaner which is simple in design.

It is a still further object of this invention to provide a method of manufacturing a single piece thread cleaner.

It is a still further object of the invention to provide a thread cleaner which is easy to install in a textile machine.

It is a still further object to provide a method of manufacturing an all-ceramic thread cleaner with a slit having a polished surface.

It is a still further object to provide a colored thread cleaner which provides contrast with white thread.

These as well as Other objects of the invention are accomplished by a method of manufacturing a single-pieced, ceramic thread cleaner comprising the steps of: (1) providing a substantially flat ceramic body having crotch in a side of the piece of ceramic, with the crotch generally forming a vertex, and (2) cutting a slot of predetermined width into the ceramic body, the slot being in communication with the vertex of the crotch, wherein the step of cutting a slot also polishes surfaces of the slot.

BRIEF DESCRIPTION OF THE DRAWINGS

The figure is a perspective view partially in phantom of a single-piece, ceramic thread cleaner manufactured according to the method of the invention, with a ribbon fed through the thread cleaner's slot.

DETAILED DESCRIPTION

In accordance with this invention, it has been found that a single-pieced, ceramic thread cleaner can be provided that is simple in design, easy to manufacture, easy to install, provides high corrosion resistance, and which is an economical alternative to prior art thread cleaners.

The figure illustrates a single-piece, ceramic thread cleaner 10 manufactured according to the method of this invention showing a ceramic body 1 with a generally V-shaped crotch 2 and a slot 3 in communication with the vertex of crotch 2. Crotch 2 facilitates the infeeding of either: thread, yarn, or a ribbon, through slot 3 of thread cleaner 10. It is important that slot 3 is a continuation of the crotch's vertex because any discontinuities between crotch 2 and slot 3 would catch an infeeding thread and break it. A bore 4 is located on the top surface 5 of ceramic body 1. Bore 4 is a machining reference point used for proper positioning of the ceramic body 1 when slot 3 and the overall ceramic thread cleaner 10 are being manufactured. The bore 4 indicates the top and left side of ceramic body 1 when it comes out of its mold. All machining steps are measured from this left side and allow for uniformity among all finished and machined products.

The process of making a single-pieced, ceramic thread cleaner begins with the pressing of a ceramic body into a predetermined shape. The predetermined shape of the ceramic body is generally that shown in FIG. 1 and comprises an elongated body 1 having crotch 2 but lacking the slot 3, which will be cut later. The pressed ceramic body is then fired at a temperature sufficient to densify the ceramic body, which causes the ceramic body to significantly shrink. The ceramic preferably used consists of 96% alumina, which is doped for sintering purposes. The ceramic AlSiMag 698, made by AlSiMag Technical Ceramics, Laurens, S.C., proved to provide excellent properties. The ceramic is preferably doped to provide color, e.g., a pink color, providing contrast between the thread and thread cleaner 10 and also preventing the ceramic body from looking as Soiled as a white ceramic article might appear. This contrast greatly assists a machine operator in identifying thread breaks, a problem plaguing this art. Thus, the color used is not based solely on aesthetics.

To cut the slot 3 into ceramic body 1, the ceramic body 1 is placed on a cut-off sawing machine 20. As described above, bore 4 is used as a reference point for proper location of the ceramic body 1 on sawing machine 20. The use of a reference point ensures that the diamond cut-off saw 21, used for sawing slot 3, enters the crotch straight through the vertex of crotch 2, and that the slot 3 will be cut in the direction of the elongation of the ceramic body 1. The width of slot 3 usually ranges between 0.005" and 0.090" according to the diameter of the thread and the desires of the customer. Since the dimensions of slot 3 are very critical, if the device is to be able to overcome the problems described with the prior art, especially concerning cleaning slubs off of ribbons, the cutting process used must generate a slot having small tolerances, preferably ±4% or,less, of the slot's width. Thus, a slot, for example, having a width of 0.012" provides a tolerance over the length of the slot of less than ±0.0005". This tolerance is first achieved by cutting the slot after the firing of the ceramic body. If the slot was cut before firing, upon firing, the size of the slot would change resulting in a degree of unpredictability as to the width and tolerance of the slot. Next, the tolerance is achieved by using a diamond cut-off saw, manufactured by Norton, having a diameter of 3–4 inches and turning at 30,000 rpm. The forward movement of ceramic body 1 during machining depends upon the width and depth of slot 3. Using this type of diamond cut-off saw results in a slot with self-polished surfaces, close tolerances, and sharp edges. This feature particularly renders the thread cleaner, manufactured according to the method of this invention, easier to produce than prior art thread cleaners because an extra polishing step is avoided.

Parallel grooves 6 and 7 are designed along the sides of ceramic body 1. Grooves 6 and 7 provide easy and perfectly aligned installation and replacement of ceramic thread cleaner 10 in a textile machine by simply pushing thread cleaner 10 into a corresponding holder which may be fixed on the textile machine. e.g. the FIG. 1 shows a ribbon 15 fed through the thread cleaner's slot. However, single threads or yarns as well as pluralities of threads or yarns can also be fed through the slot.

The thread cleaner according to this invention is made of a ceramic because an all-ceramic, single-pieced thread cleaner maintains dimensional stability over long periods of time. Also, almost all ceramics have better heat and corrosion resistance then the metals often used in thread cleaners. Finally, fabrication and installation of a single-piece thread cleaner is easier compared to prior art devices.

It is thus seen that the instant invention facilitates the manufacturing of thread cleaners significantly. A thread cleaner produced according to the process of the invention is simple in design, easy to produce, easy to install in a textile machine and suitable for thread or yarn, or a plurality of threads or yarns, and ribbon. Furthermore, the thread cleaner produced according to the process of the invention is made of but a single piece of ceramic, providing dimensional stability over a long period of time, close tolerances in the thread cleaner's slot having polished surface is, and high corrosion resistance. As many variations are apparent to one skilled in the art from reading the above specification, such variations are within the spirit and scope of the instant invention as defined by the following appended claims.

That which is claimed:

1. A single-piece ceramic thread cleaner having:

a substantially flat all-ceramic body with a crotch in a side of said ceramic body, said crotch generally forming a vertex; and a slot of predetermined width in communication with said vertex of said crotch, said slot having polished surfaces, said surfaces being substantially parallel to one another.

2. The single-piece ceramic thread cleaner according to claim wherein said slot has a width of 0.005"–0.09".

3. The single-piece ceramic thread cleaner according to claim 2, wherein said slot has a width of 0.012" and a tolerance of ±0.0005".

4. The single-piece ceramic thread cleaner according to claim 1, wherein said slot has a tolerance of about ±4% or less with respect to said predetermined width.

5. The single-piece ceramic thread cleaner according to claim 1, wherein said ceramic contains 96% aluminum.

6. The single-piece ceramic thread cleaner according to claim 1, wherein said all-ceramic body is colored.

7. The single-piece ceramic thread cleaner according to claim 1, further comprising grooves for installation of said all-ceramic body in a textile machine.

8. The single-piece ceramic thread cleaner according to claim 1, wherein the thread cleaner is of a unitary construction.

9. A unitary thread cleaner having:

a substantially flat all-ceramic body with a crotch in a side of said ceramic body, said crotch generally forming a vertex; and a slot of predetermined width in communication with said vertex of said crotch, said slot having polished side surfaces, said side surfaces being substantially parallel to one another.

* * * * *